United States Patent [19]

Pesapane

[11] Patent Number: 4,713,017

[45] Date of Patent: Dec. 15, 1987

[54] ELECTRICAL POWER RECEPTACLE

[75] Inventor: Dominic Pesapane, West Haven, Conn.

[73] Assignee: Casco Products Corporation, Bridgeport, Conn.

[21] Appl. No.: 917,701

[22] Filed: Oct. 10, 1986

[51] Int. Cl.[4] ..... H01R 13/44

[52] U.S. Cl. ..... 439/142; 439/733

[58] Field of Search ..... 339/44 R, 44 M, 166 R, 339/166 T, 176 R, 209, 217 R, 217 PS, 217 S, 192 R, 192 T, 195 R, 195 M, 195 S, 143 R, 154 R, 156 R, 157 R

[56] References Cited

U.S. PATENT DOCUMENTS

| | | | |
|---|---|---|---|
| 3,140,344 | 7/1964 | Slater et al. | 339/44 R |
| 3,284,753 | 11/1966 | Goldbaum et al. | 339/44 R |
| 4,113,333 | 9/1978 | Horowitz | 339/217 R |
| 4,197,959 | 4/1980 | Kramer | 339/44 R |
| 4,500,160 | 2/1985 | Bertsch | 339/209 |
| 4,609,242 | 9/1986 | Kemppainen | 339/217 R |
| 4,650,270 | 3/1987 | Tajima et al. | 339/143 R |

*Primary Examiner*—Gil Weidenfeld
*Assistant Examiner*—Paula A. Austin
*Attorney, Agent, or Firm*—Mitchell D. Bittman

[57] ABSTRACT

An electrical power receptacle having a tubular plastic housing with a transverse end wall at one end, and a tubular metal well which is snap fitted in the housing by means of an apertured end wall adjacent the housing end wall, cooperating with hooks in the housing. Two terminals mounted on the housing end wall project for connection to a source of power. One of the terminals engages the shell and the other terminates in an internal contact member. The housing has integral spaced-apart stand-off mounting legs, and a pivotally mounted cover plate which, when closed, seals the housing and interior contacts thereof.

23 Claims, 18 Drawing Figures

12
70
72
64
97
22
57
60
32
36
52
54
49
30
34
73
68
66

12
64
73
94
97
80
74
22
52
60
54
16
49
38
26
40
48

12
72
70
76
66
22
82
97
15
16
38
24
40
60
26
49
73
80
68
74
64

86
84
92
90
88
98

12
72
22
52
34
54
57
36
60
38
24
26
28
68
70

86
92
98
88
84
90

ELECTRICAL POWER RECEPTACLE

BACKGROUND OF THE INVENTION

1. Field of the Invention

This invention relates generally to low power electrical receptacles and more particularly to devices of the type intended to provide low voltage d.c. power to small accessories as employed in automotive vehicles of various kinds, including trucks, tractors, farm equipment, or in boats, aircraft, etc.

In particular, the invention involves a weatherproof receptacle which accommodates electric plugs receivable in conventional cigar lighter sockets to supply current to various types of equipment, such as auxiliary lights, portable compressors, etc.

2. Description of the Related Art Including Information Disclosed Under 37 CFR §§1.97–1.99

In recent years, electrical extension cords comprising cables having small molded plastic electrical plugs have been used with cigar lighter receptacles for supplying low voltage d.c. power to a various types of equipment, such as auxiliary lamps, re-chargeable flashlights, portable radios, tape recorders, air-compressors, and other devices. Also, more recently, automotive jumper cables have been developed to permit charging of a weak battery in one vehicle from the alternator of another vehicle, through the vehicles' cigar lighter sockets. Generally these jumper cables consist of a length of two-conductor electrical cord joining plugs that are inserted in the cigar lighter wells of the two vehicles.

When a cigar lighter receptacle is employed as a power outlet, the cigar lighter ignitor plug must of necessity, be removed; it often become misplaced or lost, thus resulting in loss of the cigar lighter function. Also, cigar lighter sockets are designed primarily for use with their cooperable ignitor plugs, and accordingly the numerous different socket structures that have been devised and constructed over the years do not especially lend themselves to use as power receptacles, especially in harsh environments such as where they would be exposed to moisture, dirt, oil, salt water, or other conditions involving corrosive environments.

Prior waterproof receptacles of the type intended solely for power transfer have been found to perform in a generally satisfactory manner; however they do not accept cigar-lighter type plugs and in many instances they are expensive to manufacture and produce, involving multiple parts and relatively complex components. Efforts to reduce the overall manufacturing cost often have not resulted in significant improvement in the problem of cost reduction and have degraded the quality of the receptacle. Accordingly those units which are currently available constitute somewhat of a compromise in terms of performance versus expense.

SUMMARY OF THE INVENTION

The above disadvantages and drawbacks of prior electrical power outlets are obviated by the present invention which has for an object the provision of a novel and improved power receptacle which is especially simple in construction and reliable in operation.

Still another object of the invention is to provide an improved power receptacle as outlined above, wherein the overall manufacturing cost is maintained as low as possible, without sacrifice of long life expectancy and reliability.

Yet another object of the invention is to provide an improved power receptacle of the kind indicated, wherein the components can be fabricated for the most part as molded plastic parts and simple metal stampings.

A further object of the invention is to provide an improved power receptacle as above characterized, which is especially rugged and resistant to deterioration even in harsh environments, such as where it is exposed to moisture, dirt, oil, salt water, or various types of corrosive substances.

A still further object of the invention is to provide an improved power receptacle as above set forth, which is particularly simple to manufacture and assemble, thereby maintaining the overall cost as low as possible.

Yet another object of the invention is to provide an improved power receptacle of the kind indicated, wherein the access opening of the receptacle is normally automatically closed off and sealed from the exterior when the device is not in use, thus effectively protecting the interior electrical contacts of the receptacle from unnecessary exposure to the environment and thus eliminating contact deterioration resulting from such exposure.

Other features and advantages will hereinafter appear.

In accomplishing the above objects the invention provides an electrical power receptacle comprising a tubular plastic housing having at one end a transverse end wall, and a tubular conductive metal shell which is fitted in the plastic housing and which has at its inner end a transverse wall adjacent the end wall of the housing. Cooperable means are provided on the end walls for securing them together and mounting the shell in the housing. In addition, a pair of terminals is disposed in the end wall of the housing and projects from the exterior thereof. One of the terminals is connected to the shell, and the other terminal is connected with an internal contact member on the interior of the housing end wall. The housing has a pair of integral spaced-apart stand-off legs extending laterally and respectively provided with integral mounting feet. The housing is open at the end opposite its transverse wall, and a cover plate is pivotally mounted on the stand-off legs for swinging movement between a closed position wherein it covers the open end of the housing and an open position wherein the open end is exposed and accessible. The arrangement is such that when the outlet is not in use, the housing interior is protected by the cover plate, and there is thus eliminated deterioration resulting from moisture, dirt or other debris coming to rest upon the outlet's electrical contacts.

In addition, through the use of molded plastic components and simple metal stampings, the overall manufacturing cost is significantly reduced as compared with prior, known electrical outlet constructions.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Figure 3:
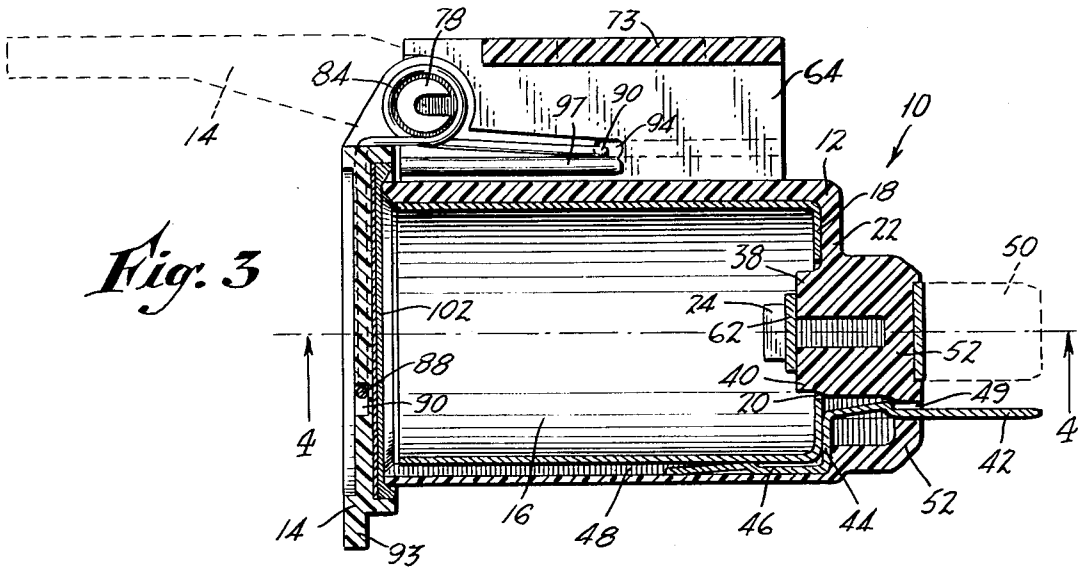
FIG. 3 is a vertical axial section taken on the line 3—3 of FIG. 1, with the cover plate being illustrated in solid outline in its closed position and in dotted outline in an open position.

Referring first to FIGS. 1-4 there is illustrated the improved weatherproof electrical power receptacle generally designated by the numeral 10 and comprising a molded plastic housing 12 of tubular configuration, and a hinged cover plate 14 carried thereby, adapted to automatically close off the open end of the housing 12 when the receptacle is not in use. FIG. 3 illustrates the cover plate 14 in solid outline occupying its closed position, whereas in dotted outline the cover plate 14 is illustrated in an open position with the housing 12 ready to receive an electric plug (not shown).

Telescopically received in the housing is an electrically conductive metal shell or well 16, having a transverse end wall 18 with an aperture 20 at its center. The end wall 18 can engage an end wall 22 of the housing 12. The dimensions of the shell 16 and plastic housing 12 are such that the shell 16 can be slid into the housing 12 through the open end thereof.

Figure 4:
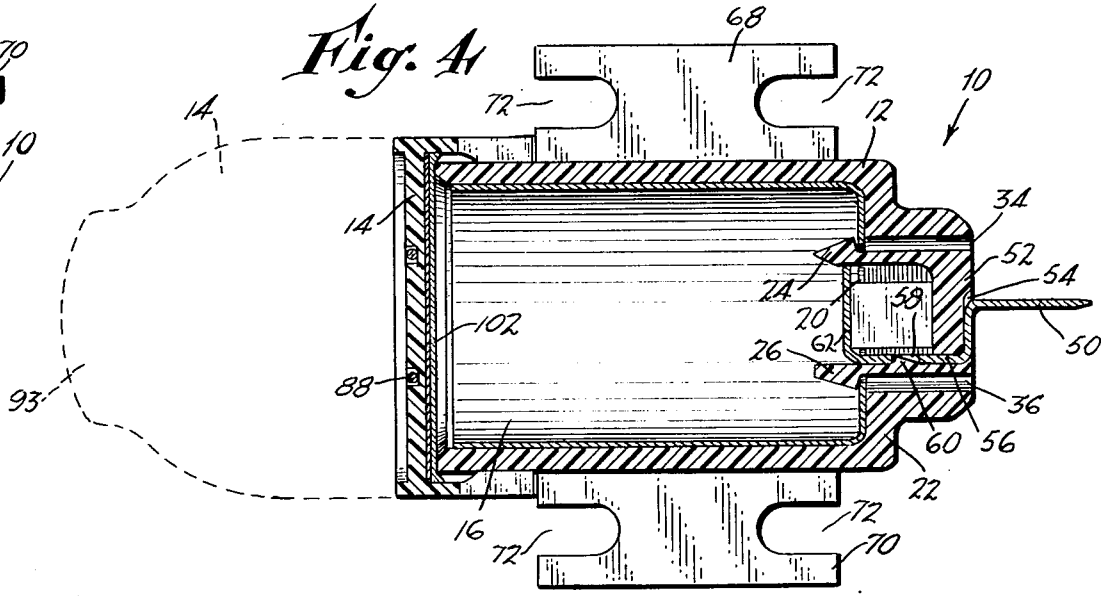
FIG. 4 is a horizontal axial section taken on the line 4—4 of FIG. 3. The cover plate is shown in solid outline in its closed position, and in dotted outline in an open position.
Figure 11:
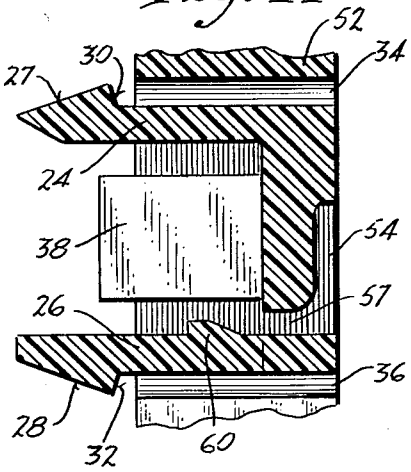
FIG. 11 is a fragmentary vertical section taken on the line 11—11 of FIG. 9.
Figure 9:
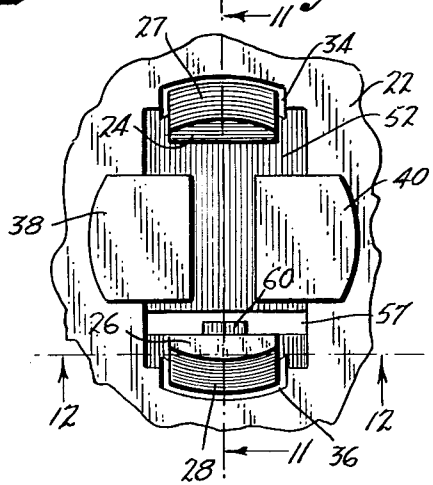
FIG. 9 is a fragmentary view of the interior of the molded plastic housing of the electrical power receptacle, looking in a direction toward the right in FIG. 16.
Figure 12:
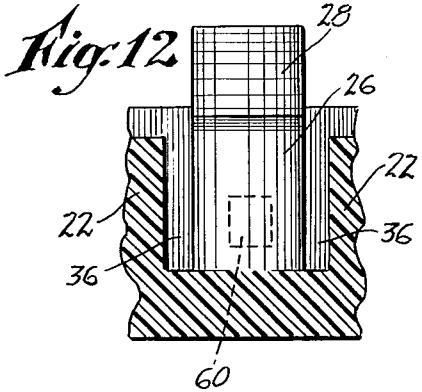
FIG. 12 is a section taken on the line 12—12 of FIG. 9.
Figure 14:
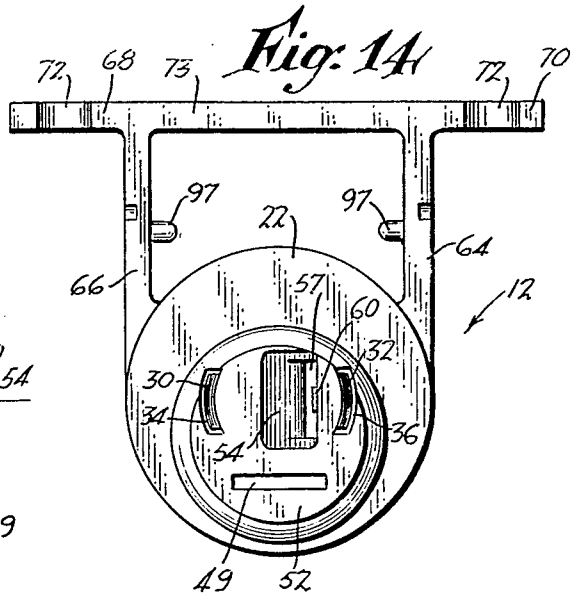
FIG. 14 is a rear elevation of the molded plastic housing of the electrical power receptacle of FIGS. 1-4 and 13, shown with the cover plate removed.

By the invention there are provided cooperable retainer means on the housing 12 and shell 16, for retaining the latter in the position shown in FIGS. 3 and 4, whereby once assembled, the shell 16 will be held captive. In accomplishing such retention, the transverse end wall 22 of the plastic housing has two forwardly extending hooks 24, 26, FIGS. 4 and 11, which have outwardly-facing camming lead-in surfaces 27, 28 respectively, FIG. 11, and associated undercuts 30, 32 respectively forming exterior shoulders. The hooks 24, 26 are molded integral with the housing 12, conveniently by the addition of slots 34, 36 which also enable the hooks 24, 26 to flex and be cammed radially inward during installation of the shell 16. The slots are the result of mold pins in the plastic mold, which enable the undercuts 30, 32 to be formed and readily permit all parts of the housing to be integral with one another. When the shell 16 is assembled to the housing 12, the hooks 24, 26 are received in the aperture 20 of the shell and yield inwardly as the camming surfaces 27, 28 respectively engage the edges of the aperture. Subsequently the end wall of the shell snaps behind the shoulders 30, 32 whereby the shell 16 is locked in the housing 12. The inner surface of the transverse or end wall 22 of the housing 12 has a pair of protrusions or bosses 38, 40, FIG. 13, which are received in the aperture 20 of the shell 16 and which also provide a back-up shoulder for one of the receptacle contacts, as will be explained below.

By the invention there is provided a first terminal 42, FIG. 3, carried by the transverse end wall 22 of the housing 12 and protruding therefrom for connection to a suitable electrical connector (not shown). Integral with the terminal 42 is a connector portion 44 and also a leaf spring 46 of flattened Z-shaped cross section. Also, there is provided in the inner surface of the housing a longitudinal groove 48, FIGS. 3 and 15, in which the leaf spring 46 is received. The resilience of the spring 46 results in a pressure contact with the outer surface of the shell 16 whereby there is established a good electrical connection thereto. The terminal 42 and integral spring 46 are inserted into a slot 49 in the transverse wall 22 of the housing 12 from the front thereof, prior to installation of the shell 16. The leading edge of the spring 46 is recessed in the groove 48 such that it cannot become caught on or interfere with the insertion of the shell 16, as can be readily understood.

Referring again to FIGS. 2 and 4, by the invention there is provided a second terminal 50 carried by the transverse wall 22 of the plastic housing 12 and electrically insulated from the first terminal 42. The rear surface of the housing wall 22 has an extension or boss 52. As shown, the second terminal 50 is seated in a recess 54 in the boss 52 of the wall 22, and has a connecting portion 56 which extends through a slot 57 (FIG. 16) in the wall. A hole 58 in the connecting portion 56 is provided, FIG. 4, and a projecting retainer tooth 60, FIGS. 15 and 16, disposed in the slot 57 is received in the hole 58 after the terminal 50 is installed. One edge of the hole 58 constitutes a temporary retainer shoulder for the terminal 50, which is inserted through the slot 57 from the rear of the housing. Integral with the connecting portion 56 is a contact portion 62 that is disposed at a right angle with respect to the portion 56. The bend between the portions 56 and 62 is made after the terminal part 50 is inserted. The contact portion 62 ultimately extends across both of the internal bosses 38, 40 of the housing wall 22 and lies in a plane which is perpendicular to the axis of the housing 12 and shell 16 as shown in FIGS. 3 and 4. The terminal 50 and contact 62 are retained in this position by the bend, FIG. 4. Prior to formation of the bend, the terminal 50 is retained by the tooth 60, as noted above.

Figure 6:
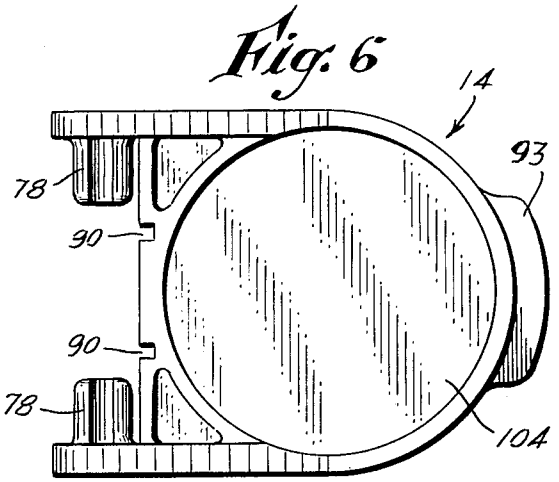
FIG. 6 is a bottom plan view of the cover plate of FIG. 5.
Figure 7:
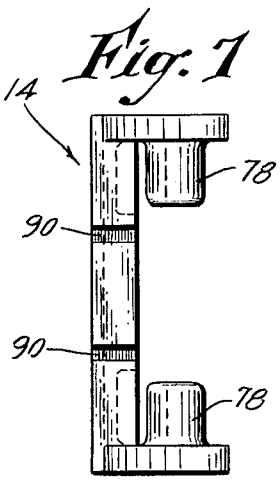
FIG. 7 is a right end elevation of the cover plate of FIG. 5.
Figure 15:
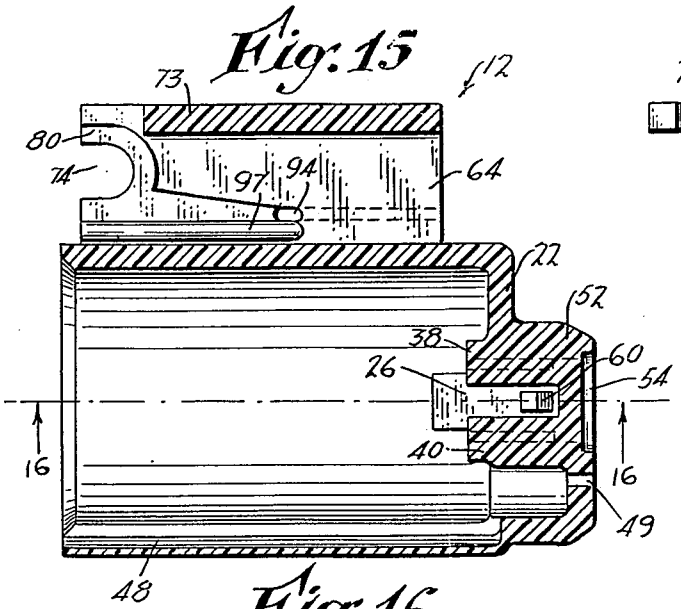
FIG. 15 is a vertical axial section taken on the line 15—15 of FIG. 13.
Figure 13:
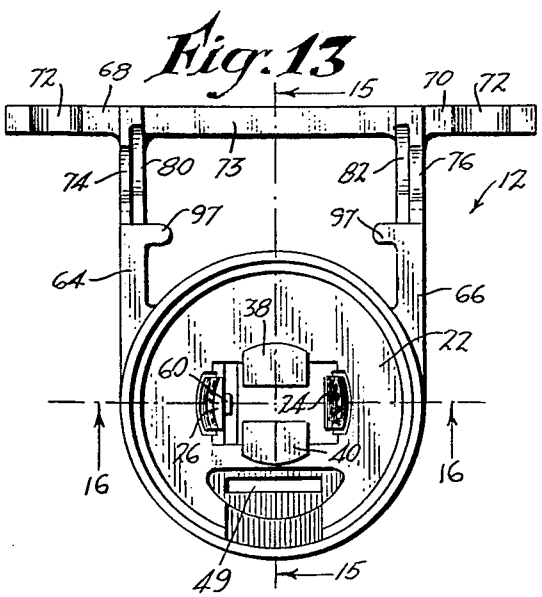
FIG. 13 is a front elevation of the molded plastic housing of the electrical power receptacle of FIGS. 1-4, shown with the cover plate removed.
Figure 18:
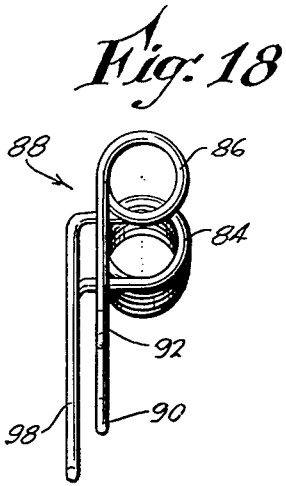
FIG. 18 is a view of the spring means of FIG. 17, taken in the direction of the arrow shown therein.
Figure 16:
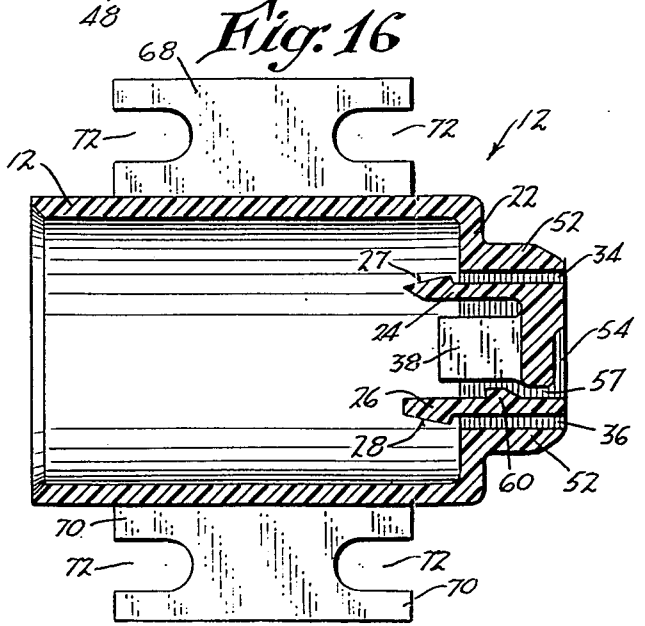
FIG. 16 is a horizontal axial section taken on the line 16—16 of FIG. 13, and the line 16—16 of FIG. 15.

Further in accordance with the invention the plastic housing 12 is provided with a pair of laterally extending support legs 64, 66, FIG. 13, which terminate in mounting feet 68, 70 respectively. The mounting feet 68, 70 have slots 72 at their opposite sides, by which the housing can be mounted to a support surface (not shown) with suitable threaded fasteners (not shown). A bridging member 73 extends between and connects the legs 64, 66. Referring to FIGS. 13 and 15, the legs 64, 66 of the housing are provided with cylindrical sockets 74, 76 respectively intended to receive trunnions 78 that are integral with the cover plate 14, shown in FIGS. 5–7. The trunnions 78 are axially aligned with one another, and have cored out radial slots, if desired, to reduce the amount of plastic substance required for molding.

Figure 1:
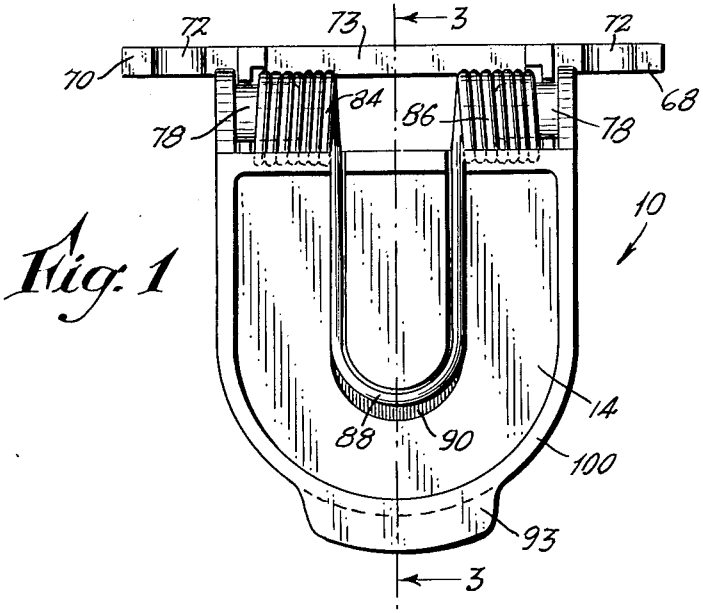
FIG. 1 is a front elevational view of the electrical power receptacle of the invention, comprising a molded plastic tubular housing and a hinged, spring-biased cover plate disposed in its closed position covering the opening of the housing.

The trunnions 78 are received in the sockets 74, 76 respectively of the housing, as in FIGS. 1 and 3. As seen in FIG. 13, there are also provided clearance spaces or slots 80, 82 which provide seats for two oppositely-disposed coils 84, 86 of a spring means 88 to be described below.

Figure 5:
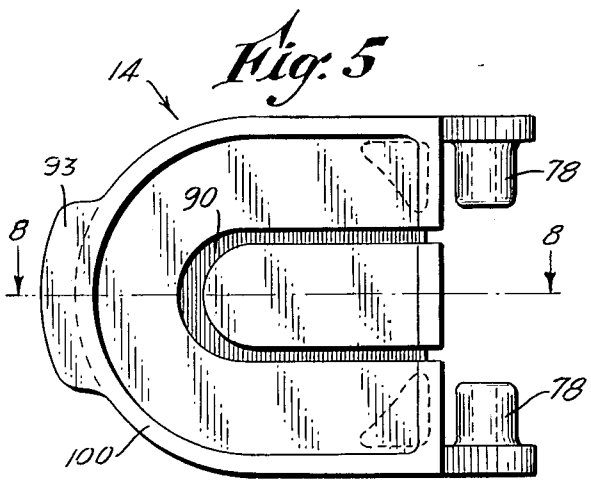
FIG. 5 is a top plan view of the cover plate per se, as provided for the electrical power receptacle of FIGS. 1-4.
Figure 8:
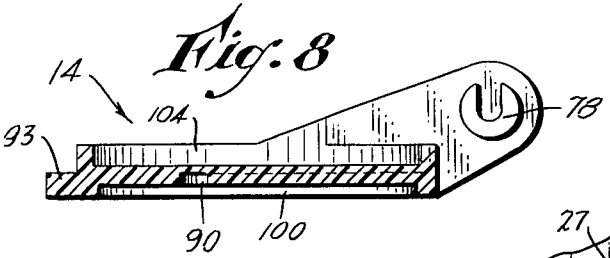
FIG. 8 is a section taken on the line 8—8 of FIG. 5.
Figure 10:
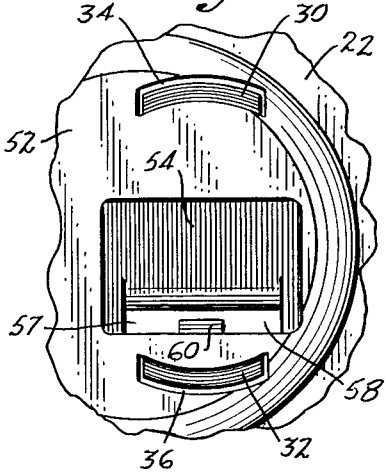
FIG. 10 is a fragmentary right end elevational view of the molded plastic housing of the electrical power receptacle, viewed from the right in FIG. 16.
Figure 17:
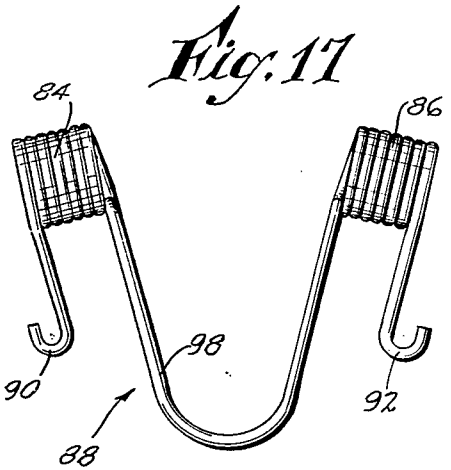
FIG. 17 is a front elevational view of spring means associated with the electrical power receptacle of FIGS. 1-4.

Referring to FIG. 5, the front surface of the cover plate 14 has a generally U-shaped groove 90 that extends downward from the top of the plate toward a finger-engageable lifting tab 93 thereof. FIG. 17 illustrates the one-piece spring means 88 employed with the cover plate 14.

By this invention the spring means 88 operates both to automatically bias the cover plate 14 to its normally closed position, shown in solid outline in FIGS. 1 and 3 of the drawings, and to hold captive the cover plate 14 at all times, regardless of whether it is in its fully closed or in its open position. In accomplishing the latter object, the ends of the spring means 88 have hooks 90, 92, shown particularly in FIG. 17. The legs 64, 66 of the housing have small openings 94, 96, FIG. 2, of a size sufficient to receive the hooks 90, 92 respectively when the spring means 88 is installed as in FIGS. 1 and 2. As seen in FIG. 17, when initially formed the spring means 88 has a central V-shaped portion 98, and the two tight wound coils 84, 86 are on opposite sides of the V-shaped portion. As shown, the axes of the tight wound coils 84, 86 are non-coaxial or skewed with respect to one another. During installation, the two coils 84, 86 are urged toward one another such that they become essentially coaxial. The V-shaped portion 98 now is U-shaped whereby it can be fitted into the U-shaped groove or recess 90 in the front of the cover plate 14. The latter can then be readily assembled to the housing 12, with the trunnions 78 being received in the corresponding sockets 74, 76 of the housing and with a 90 degree swing being imparted to the legs of the spring means 88. These hooks can then be inserted in the openings 94, 96 of the housing and anchored therein, since they will be biased in opposite directions, away from one another, which has the desired effect of maintaining the seating of the hooks 90, 92. As a consequence, the spring means 88 retains the trunnions 78 against inadvertent removal from the sockets 74, 76 regardless of the open/closed condition of the cover plate 14. The retention can be best understood by referring to FIGS. 2 and 3. The spring means is preferably constituted of conventional wire stock having a generally circular cross section.

Figure 2:
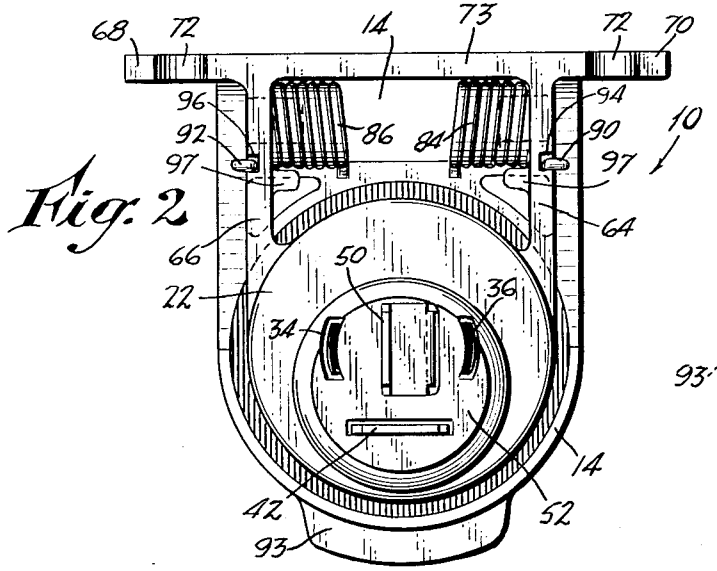
FIG. 2 is a rear elevational view of the electrical power receptacle of FIG. 1.

A pair of integral guide rails or ribs 97, FIGS. 2 and 13, facilitates installation of the spring means 88 by directing the hooks 90, 92 into the respective retainer holes 94, 96.

Referring again to FIGS. 3 and 4, it can be seen that the depth of the groove 90 in the front surface of the cover plate 14 is such that it slightly exceeds the diameter of the wire stock of which the spring means 88 is constituted. The spring means 88 is thus disposed mostly below the surrounding front surfaces of the cover plate 14. As shown in the drawings, the front surface can be recessed, or can have an upstanding peripheral lip 100 suitable for retention of a disk-like nameplate or other ornamentation (not shown). For example, wording such as "12 VOLT POWER OUTLET" could be incorporated on a plastic cover piece (not shown), and the piece inserted in the recess formed by the lip 100, being retained with suitable adhesive. Such a cover piece would thus convey information relating to the function of the device, as well as concealing both the spring means 88 and the groove 90.

FIGS. 3 and 4 additionally show a sealing gasket 102 of disk-like configuration, adapted to placed on the inside of the cover plate 14. The inside of the cover plate is preferably provided with a circular recess 104, FIG. 6, having a depth somewhat exceeding that of the gasket. The gasket 102 can be fabricated of any suitable sealing material, such as rubber, plastic, etc. Preferably the gasket 102 has a self-adhesive backing by which it is permanently secured in the recess 104. With such arrangement, when the cover plate 14 is disposed in its closed position, the interior of the housing 12 and the contacts thereof comprising the contact 62 and the inner surface of the shell 16, are effectively isolated from the outside of the housing. There is thus minimized possible deterioration in the integrity of the contacts as might otherwise result from accumulation of dirt, moisture, corrosive substances, etc.

The disclosed construction is seen to have the following important advantages. Manufacturing cost is kept to an absolute minimum. By the provision of a unique housing structure and judiciously chosen retainer structures for the various metal parts therein, the housing can be molded as a single piece, with all portions thereof being integral with one another. In addition, the cover plate 14 can be molded as a single integral piece.

Assembly of the two terminals 42, 50 to the housing 12 is readily accomplished. As noted above, the terminal 50 is assembled to the housing through a slot in the transverse end wall thereof, from the rear. The terminal 42 and its spring portion 46 are assembled from the front of the housing, through the open end thereof. The same is true of the tubular metal shell 16.

The resilient mechanical and electrical contact between the spring 46 and the shell 16 has been found to be adequate for establishing the electrical connection between these two components. The need for soldering or welding operations between the spring means and shell is thus eliminated.

An especially simple arrangement for retention of the cover plate is shown, through the use of the special spring means 88. The spring means 88 also functions to bias the plate toward its closed position. The entire outlet construction is thus simplified by such use of the spring means for accomplishing this dual-function.

The electrical outlet receptacle of the present invention is thus seen to represent a distinct advance and improvement in the field of electrical connector devices.

Variations and modifications are possible without departing from the spirit of the invention.

Each and every one of the appended claims defines an aspect of the invention which is separate and distinct from all others, and accordingly it is intended that each claim be treated in this manner when examined in light of the prior art devices in any determination of novelty or validity.

What is claimed is:

1. An electrical power receptacle comprising, in combination:
(a) a tubular plastic housing having at one end a transverse end wall, the other end of the housing being open to receive an electric plug,
(b) a tubular metal well which is fitted in said plastic housing, said well having at its inner end a transverse end wall adjacent the end wall of the housing,
(c) cooperable means on said end walls for securing the same together to thereby secure the well in said housing,
(d) a pair of terminals mounted in the end wall of the housing and projecting from the exterior thereof, one of said terminals being electrically connected to said metal well,
(e) an internal contact member on the interior of the housing end wall, connected to the other of said terminals,
(f) said housing having a pair of integral spaced-apart stand-off legs extending laterally from its exterior and respectively provided with integral mounting feet,
(g) a cover plate for closing the open end of the housing, and
(h) means pivotally mounting said cover plate on said stand-off legs for pivotal movement between a closed position wherein it covers the open end of the housing and an open position wherein it uncovers the said open end.

2. A power receptacle as set forth in claim 1, further including:
(a) a bridging member extending between and connecting the extremities of said stand-off legs.

3. A power receptacle as set forth in claim 1, further including:
(a) spring means biasing said cover plate to its closing position.

4. A power receptacle as set forth in claim 1, and further including:
(a) sealing means on the inside of the cover plate, engageable with the open end of the housing to effect a seal therewith when the cover plate is in its closed position.

5. A power receptacle as set forth in claim 1, wherein:
(a) said cooperable means on said end walls comprises a hook on one of said walls and means defining an aperture in the other wall, in which the hook is received.

6. A power receptacle as set forth in claim 1, wherein:
(a) said cover plate has a recess in its surface, in which a portion of the spring means is received.

7. A power receptacle as set forth in claim 1, wherein:
(a) the housing has a boss on the exterior of the end wall thereof,
(b) said boss being offset laterally of the axis of the housing,
(c) said pair of terminals projecting from said boss.

8. A power receptacle as set forth in claim 1, wherein:
(a) said pivotal mounting means comprises trunnions on said cover plate, and
(b) means defining sockets in said legs, receiving said trunnions.

9. A power receptacle as set forth in claim 8, and further including:
(a) spring means carried by said trunnions, biasing the cover plate to its closing position.

10. A power receptacle as set forth in claim 9, wherein:
(a) the sockets in the stand-off legs comprise open-ended slots for receiving the trunnions of the cover plate laterally,
(b) end portions of the spring means being anchored in the stand-off legs to thereby hold the cover plate captive on the housing.

11. A power receptacle as set forth in claim 9, wherein:
(a) said spring means are disposed between the stand-off legs.

12. A power receptacle as set forth in claim 9, wherein:
(a) said spring means comprises a pair of wire coil springs and a U-shaped connecting wire yoke portion extending laterally of the axis of the springs.

13. A power receptacle as set forth in claim 12, wherein:
(a) said spring means comprises end portions extending laterally of the axis of the springs,
(b) said end portions being anchored in said legs.

14. A power receptacle as set forth in claim 13, wherein:
(a) said stand-off legs comprise feet respectively, and
(b) a bridging member extending between and connecting the feet of said stand-off legs.

15. An electrical power receptacle comprising, in combination:
(a) a tubular plastic housing having at one end a transverse end wall, the other end of the housing being open to receive an electric plug,
(b) a tubular metal shell which is received in said plastic housing,
(c) cooperable snap retainer means on said shell and housing, for securing the same together to thereby mount the shell in said housing,
(d) a pair of terminals mounted on the housing and projecting from the exterior thereof, one of said terminals being electrically connected to said metal shell, for establishing a circuit to one part of said electric plug, and
(e) an internal contact member on the interior of the housing transverse end wall, connected to the other of said terminals, for establishing a circuit to another part of said electric plug.

16. The invention as set forth in claim 15, wherein:
(a) said shell has a transverse end wall,
(b) said cooperable retainer means comprising two projections on the inner surface of the transverse end wall of the housing, and
(c) means defining an aperture in the transverse end wall of the shell,
(d) said projections having shoulders respectively engageable with oppositely disposed areas of the walls of the aperture, to thereby hold captive the shell.

17. The invention as set forth in claim 15, wherein:
(a) said shell has an aperture at its inner end, and
(b) the said internal contact member being accessible through the aperture, for engagement by one part of the electric plug.

18. The invention as set forth in claim 15, wherein:
(a) the inner surface of said plastic housing has a longitudinal clearance groove, and
(b) a resilient electrically conductive spring strip connected to said one terminal, said strip being carried in said clearance groove and being sandwiched between the wall of said groove and the outer surface of the tubular shell so as to establish good electrical contact therewith.

19. The invention as set forth in claim 18, wherein:
(a) said strip has a flattened Z-shaped cross section, and the resiliency of the strip maintaining pressure on the outer surface of the shell.

20. The invention as set forth in claim 15, wherein:
(a) said shell has a transverse end wall,
(b) said cooperable retainer means comprising a projection on the inner surface of the transverse end wall of the housing, and
(c) means defining an aperture in the transverse end wall of the shell,
(d) said projection having a shoulder engageable with the walls of the aperture, to thereby hold captive the shell.

21. The invention as set forth in claim 20, wherein:
(a) said projection is integral with the transverse end wall of the tubular plastic housing, and
(a) said housing transverse end wall having an opening adjacent the projection to provide access to the shoulder thereof from the exterior of the said end wall, said projection and housing being molded as a single integral piece.

22. An electrical power receptacle comprising, in combination:
(a) a tubular plastic housing part having at one end a transverse end wall, the other end of the housing part being open to receive an electric plug,
(b) means at the interior of the housing part, providing a pair of electrical contacts for engagement by corresponding parts of the electric plug,
(c) a pair of terminals mounted on the housing part, and being respectively electrically connected with said electrical contacts,
(d) a cover part for closing the open end of the housing part,
(e) one of said parts having a pivot pin and the other of said parts having a socket in which the pivot pin is removably receivable, and
(f) spring means engaging said housing part and said cover part, for retaining the pivot pin in the said socket, and for biasing the cover part toward a position closing the open end of the housing part.

23. The invention as set forth in claim 22, wherein:
(a) said cover part has a U-shaped recess in its front face, for receiving a portion of the spring means,
(b) said pin being carried on said cover part, and said housing part containing said socket,
(c) said housing part having a recess at its exterior,
(d) said spring means having a retainer hook at one of its ends, said hook being received in the said recess in the housing part thereby to hold captive the spring means,
(e) said spring means further comprising a U-shaped portion received in the recess of the cover part so as to hold captive the latter on the housing part.

* * * * *